US006640668B2

(12) United States Patent
George et al.

(10) Patent No.: US 6,640,668 B2
(45) Date of Patent: Nov. 4, 2003

(54) HAND GUARD FOR DRILLING RIG HAND TONGS

(75) Inventors: William George, St. Albert (CA); Ross Ward, Leduc (CA)

(73) Assignee: Katch Kan Holdings Ltd., Edmonton (CA)

( * ) Notice: Subject to any disclaimer, the term of this patent is extended or adjusted under 35 U.S.C. 154(b) by 0 days.

(21) Appl. No.: 10/016,450

(22) Filed: Oct. 30, 2001

(65) Prior Publication Data

US 2003/0013393 A1 Jan. 16, 2003

(30) Foreign Application Priority Data

Jul. 16, 2001 (CA) ..... 2353510

(51) Int. Cl.[7] ..... B25B 23/16; B25G 1/01
(52) U.S. Cl. ..... 81/57.33; 81/177.6; 81/489
(58) Field of Search ..... 81/57.33, 57.15, 81/177.1, 489, 491, 492, 487, 177.8, 177.6; 175/424; 451/451, 455

(56) References Cited

U.S. PATENT DOCUMENTS 101,307 A 3/1870 Pearson
598,024 A * 1/1898 Gorman ..... 267/44
2,703,221 A * 3/1955 Gardner ..... 81/57.18
3,832,912 A * 9/1974 Edwards ..... 74/551.8
4,572,545 A 2/1986 Dooley, Jr. et al.
4,609,055 A * 9/1986 Grafstrom et al. ..... 173/162.2
4,768,288 A 9/1988 Culbertson
5,125,160 A 6/1992 Gassen
5,172,773 A 12/1992 Meister et al.
5,188,362 A 2/1993 Ashihara
5,333,925 A * 8/1994 Foley, Jr. ..... 294/86.4
5,632,090 A 5/1997 Smith
5,673,599 A 10/1997 Byers et al.
5,823,074 A * 10/1998 Ahlstone ..... 81/57.34
5,823,922 A 10/1998 Eckmann
6,061,862 A * 5/2000 Whitaker ..... 15/111
6,081,958 A 7/2000 Van Staagen
6,119,558 A * 9/2000 Foley, Jr. ..... 81/90.5
6,327,940 B1 * 12/2001 Price ..... 81/177.1

* cited by examiner

*Primary Examiner*—George Nguyen
*Assistant Examiner*—Hadi Shakeri
(74) *Attorney, Agent, or Firm*—Davis & Bujold, P.L.L.C.

(57) ABSTRACT

A hand guard for drilling rig hand tongs includes a resilient body having a first end and a second end. Clamps are provided for securing the first end of the body along a first edge of a jaw of the drilling rig hand tongs adjacent to a hand gripping bar. Clamps are provided for securing the second end of the body along a second edge of the jaw adjacent to the hand gripping bar. The body extends above and shields the hand gripping bar.

6 Claims, 4 Drawing Sheets

HAND GUARD FOR DRILLING RIG HAND TONGS

FIELD OF THE INVENTION

The present invention relates to a hand guard for drilling rig hand tongs.

BACKGROUND OF THE INVENTION

Every drilling rig has hand tongs which are used for gripping drill pipe and other tubulars. Hand tongs are operated by gripping "C" shaped handles. Accidents have occur every year in which drilling personnel gripping the "C" shaped handles have sustained crushed hands or fingers.

SUMMARY OF THE INVENTION

What is required is a form of hand guard which can be retrofit onto existing hand tongs.

According to the present invention there is provided a hand guard for drilling rig hand tongs which includes a resilient body having a first end and a second end. Means is provided for securing the first end of the body along a first edge of a jaw of the drilling rig hand tongs adjacent to a hand gripping bar. Means is provided for securing the second end of the body along a second edge of the jaw adjacent to the hand gripping bar. The body extends above and shields the hand gripping bar.

Two embodiments of hand guard will hereinafter be further described. A preferred embodiment clamps onto supporting bars supporting the hand gripping bar of existing drilling rig hand tongs to provide protection against crushed hands and fingers. An alternative embodiment clamps onto an edge of a jaw of the drilling rig hand tongs adjacent to the hand gripping bar.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
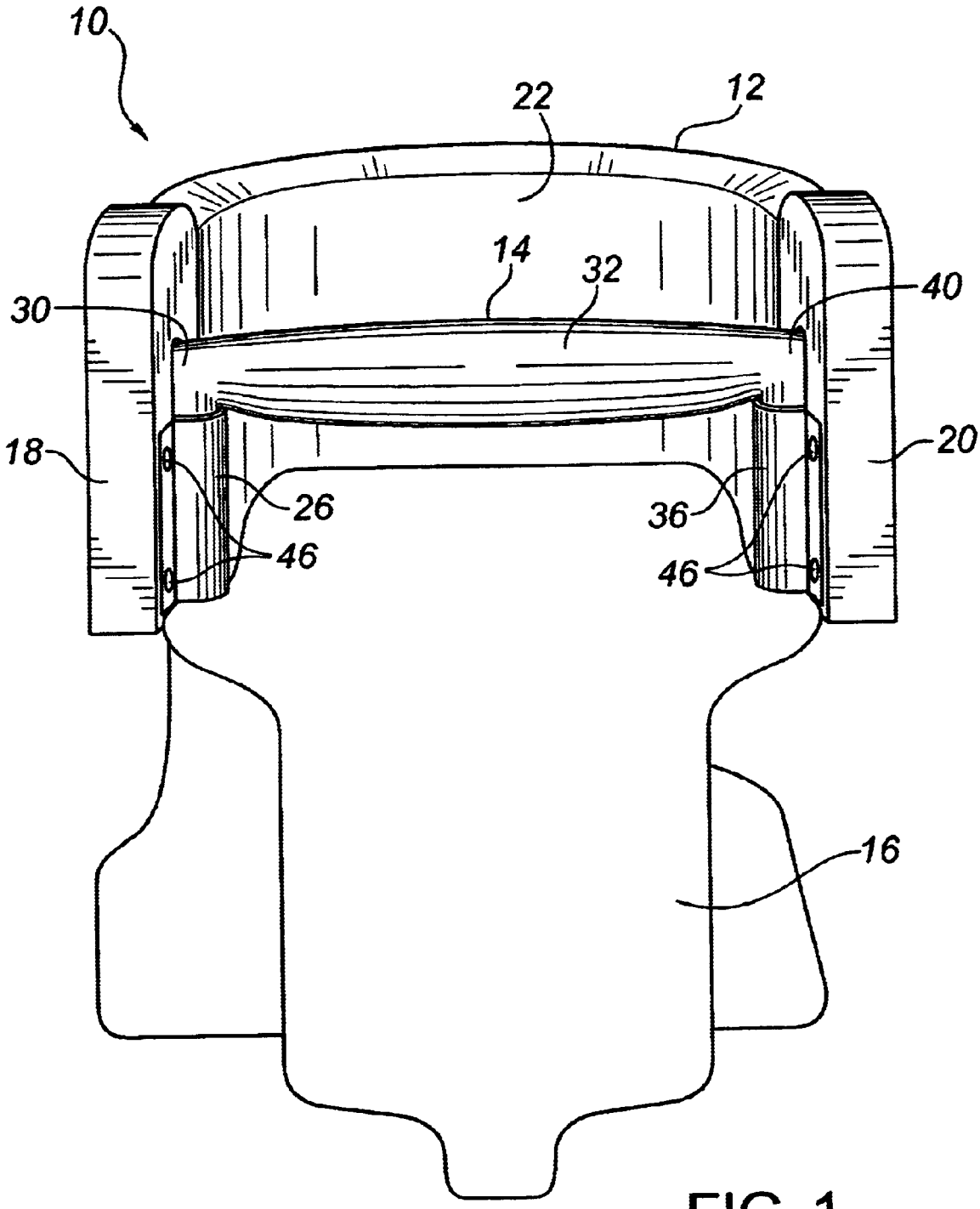
FIG. 1 is a perspective view of a preferred embodiment of hand guard for drilling rig hand tongs constructed in accordance with the teachings of the present invention in position on a handle of a drilling rig hand tongs.

The preferred embodiment, a hand guard for drilling rig hand tongs generally identified by reference numeral 10, will now be described with reference to FIGS. 1 through 4.

Figure 2:
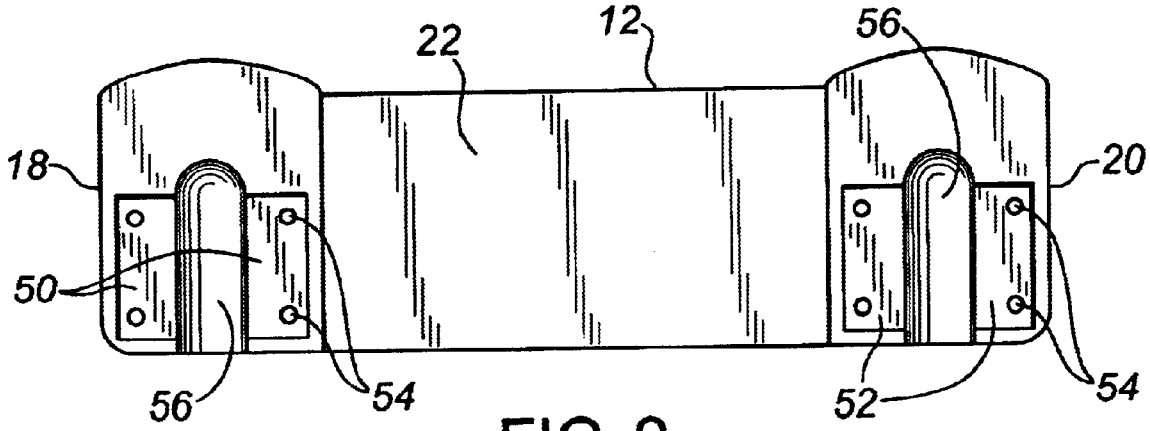
FIG. 2 is a top plan view of a body of the hand guard illustrated in FIG. 1, detached from the handle of the drilling rig hand tongs.
Figure 3:
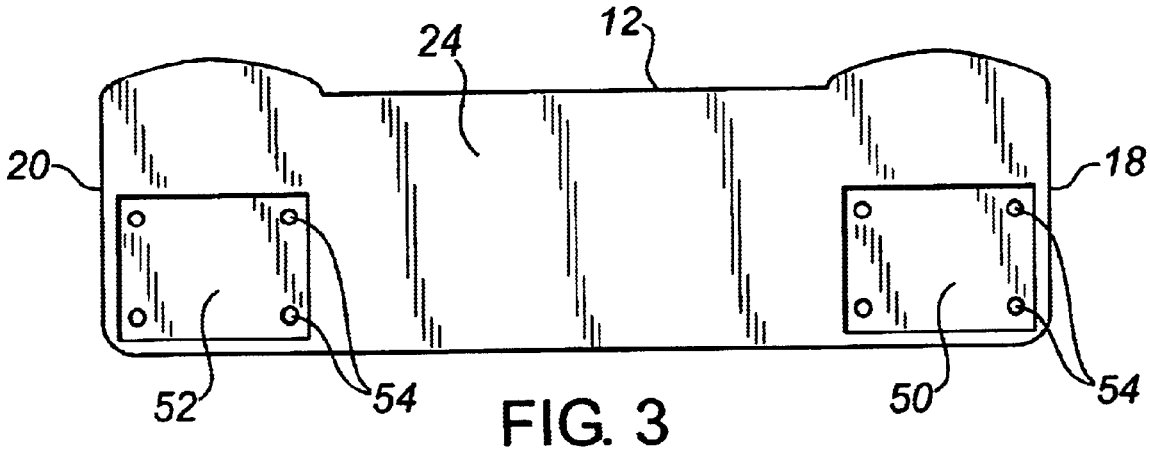
FIG. 3 is a bottom plan view of the body of the hand guard illustrated in FIG. 1, detached from the handle of the drilling rig hand tongs.
Figure 4:
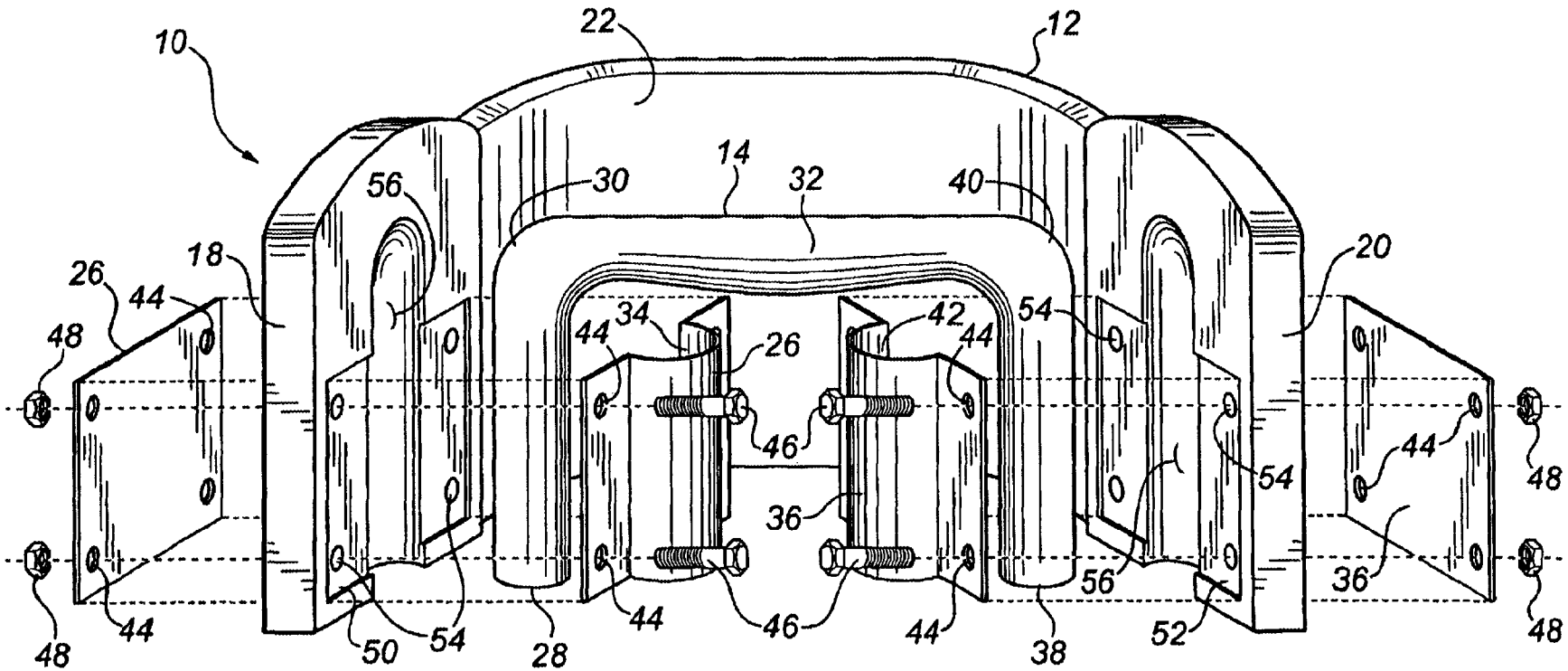
FIG. 4 is an exploded side elevation view of a pair of clamping plates clamping the body of the hand guard onto the handle of the drilling rig hand tongs, as illustrated in FIG 1.

Structure and Relationship of Parts:

Referring to FIG. 1, hand guard 10 includes a body 12 capable of assuming a "C" shaped configuration, thereby guarding a handle 14 of drilling rig hand tongs 16. Referring to FIGS. 2 and 3, body 12 of hand guard 10 has a first end 18, a second end 20, a first side 22 and a second side 24. Referring to FIGS. 1 and 4, a first pair of clamping plates 26 are provided that are adapted to clamp first end 18 of body 12 to a first support bar 28 which supports a first end 30 of a gripping bar 32 of handle 14 of hand tongs 16. One of first pair of clamping plates 26 has a receiving channel 34 adapted to receive first support bar 28. A second pair of clamping plates 36 are provided that are adapted to clamp second end 20 of body 12 to a second support bar 38 supporting a second end 40 of gripping bar 32 of handle 14 of drilling rig hand tongs 16. One of second pair of clamping plates 36 also has a receiving channel 42 that is adapted to receive second support bar 38. In the illustrated embodiment, one of first pair of clamping plates 26 and one of second pair of clamping plates 36 have a receiving channel adapted to receive first support 28 bar and second support bar 38, however, it will be appreciated that receiving channels could be in both of first pair of clamping plates 26 and both of second pair of clamping plates 36 and still function. Several receiving apertures 44 are provided in first pair of clamping plates 26 and second pair of clamping plates 36 for receiving fasteners such as a bolts 46 with a securing nut 48.

Referring to FIGS. 2 and 3, recesses 50 are provided in first side 22 and second side 24 of body 12 at first end 18 wherein first pair of clamping plates 26 are positioned. Recesses 52 are also provided in first side 22 and second side 24 of body 12 at second end 20 of body 12 wherein second pair of clamping plates 36 are positioned. Apertures 54 are provided in recesses 50 and recesses 52. Referring to FIG. 4, apertures 54 are adapted to receive bolts 46. Referring to FIG. 4, receiving channels 56 are provided in first side 22 of body which are adapted to receive first support bar 28 and second support bar 38.

Operation:

The use and operation of hand guard 10 will now be described with reference to FIGS. 1 through 4. Referring to FIGS. 1 and 4, as described above, each handle 14 on drilling rig hand tongs 16 includes first support bar 28, second support bar 38 and gripping bar 32 which extends between first support 28 bar and second support bar 38.

As body 12 of hand guard 10 is made from a flexible and resilient elastomer, body 12 can be shaped into "C" configuration for installation on handle 14. First pair of clamping plates 26 are used to secure first end 18 of body 12 to first support bar 28 which has been positioned in one of receiving channels 56 in first side 22 of body 12. Second pair of clamping plates 36 are used to secure second end 20 of body 12 to second support bar 38 which has been positioned in another of receiving channels 56 in first side 22 of body 12. Bolts 46 with securing nuts 48, or other similar types of fasteners can be used to secure first pair of clamping plates 26 and second pair of clamping plates 36 to body 12.

Because body 12 of hand guard 14 is made of flexible and resilient elastomer, body 12 is flexible enough to be made to bend into a "C" shaped configuration, yet remains resilient enough to protect hands of drilling rig personnel from being crushed.

Figure 5:
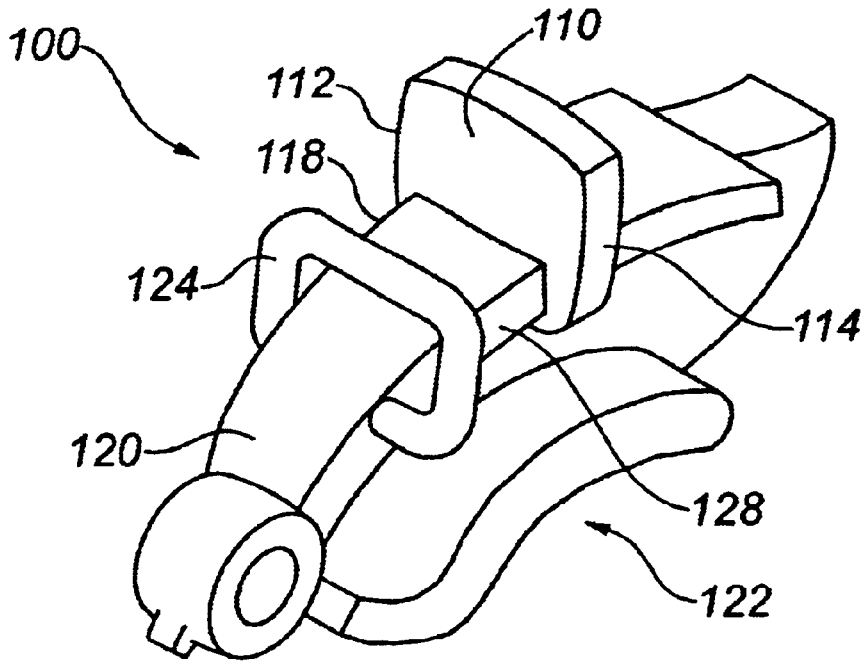
FIG. 5 is a perspective view of an alternative embodiment of hand guard for drilling rig hand tongs constructed in accordance with the teachings of the present invention in position on drilling rig hand tongs.
Figure 6:
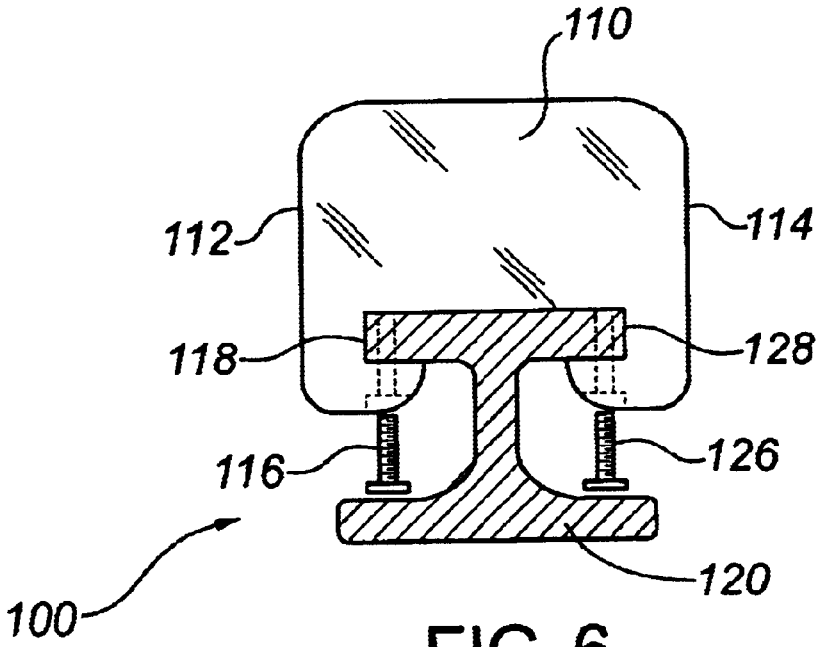
FIG. 6 is an end elevation view, in section, of the hand guard illustrated in FIG. 5.

Alternative Embodiment:

Referring to FIGS. 5 and 6, there is illustrated an alternative embodiment of a hand guard for drilling rig hand tongs 100 which includes a resilient body 110 with a first 112 end and a second end 114. A first clamping screw 116 is provided for securing first end 112 of body 110 along a first edge 118 of a jaw 120 of a drilling rig hand tongs 122 adjacent to a hand gripping bar 124. A second clamping screw 126 is provided for securing second end 114 of body 112 along a second edge 128 of jaw 120 adjacent to hand gripping bar 124 such that body 112 extends above and shields hand gripping bar 124.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A hand guard for drilling rig hand tongs, comprising:

a resilient body capable of assuming a "C" shaped configuration, thereby guarding a handle of the drilling rig hand tongs, the body having a first end and a second end;

a first pair of clamping plates adapted to clamp the first end of the body to a first support bar supporting a first end of a gripping bar of the handle of the drilling rig hand tongs, at least one of the first pair of clamping plates having a receiving channel adapted to receive the first support bar; and a second pair of clamping plates adapted to clamp the second end of the body to a second support bar supporting a second end of the gripping bar of the handle of the drilling rig hand tongs, at least one of the second pair of clamping plates having a receiving channel adapted to receive the second support bar.

2. The hand guard as defined in claim 1, wherein the body is made from a flexible and resilient elastomer.

3. The hand guard for drilling rig hand tongs as defined in claim 1, wherein recesses are provided in the body where the first pair of clamping plates and the second pair of clamping plates are positioned.

4. The hand guard for drilling rig hand tongs as defined in claim 1, wherein receiving channels are provided in the body which are adapted to receive the first support bar and the second support bar.

5. In combination:

drilling rig hand tongs having a pair of handles, each of the handles comprised of a first support bar, a second support bar and a gripping bar that extends between the first support bar and the second support bar; and a hand guard for drilling rig hand tongs, comprising:

a body positioned in a "C" shaped configuration guarding one of the handles, the body having a first end and a second end;

a first pair of clamping plates adapted to clamp the first end of the body to the first support bar of one of the handles of the drilling rig hand tongs, at least one of the first pair of clamping plates having a receiving channel in which the first support bar is received;

a second pair of clamping plates adapted to clamp the second end of the body to the second support bar of one of the handles of the drilling rig hand tongs, at least one of the second pair of clamping plates having a receiving channel in which the second support bar is received.

6. In combination:

drilling rig hand tongs having a pair of handles each handle comprising a first support bar, a second support bar and a gripping bar extending between the first support bar and the second support bar; and a hand guard for drilling rig hand tongs comprising:

a body positioned in a "C" shaped configuration guarding one of the pair of handles and the body having a first end and a second end;

a first pair of clamping plates adapted to clamp the first end of the body to the first support bar of said one of the pair of handles of the drilling rig hand tongs, one of the first pair of clamping plates being secured to the first support bar; and a second pair of clamping plates adapted to clamp the second end of the body to the second support bar of said one of the pair of handles of the drilling rig hand tongs, one of the second pair of clamping plates being secured to the second support bar.

* * * * *